United States Patent [19]

Benoist et al.

[11] Patent Number: 4,815,209

[45] Date of Patent: Mar. 28, 1989

[54] KNIVES FOR A GRID-TYPE SHAVER, A SUPPORT FOR THE SHAVER KNIVES, AND A METHOD FOR SHARPENING AND MOUNTING SAID KNIVES

[75] Inventors: André Benoist, Besancon; Jean Hennuy, Chervinges, both of France

[73] Assignee: SEB S.A., Selongey, France

[21] Appl. No.: 814,735

[22] Filed: Dec. 30, 1985

[30] Foreign Application Priority Data

Jan. 9, 1985 [FR] France ..... 85 00247

[51] Int. Cl.[4] ..... B26B 19/04

[52] U.S. Cl. ..... 30/43.92; 30/346.51

[58] Field of Search ..... 30/43.92, 346.51

[56] References Cited

U.S. PATENT DOCUMENTS

| | | | |
|---|---|---|---|
| 3,376,636 | 4/1968 | Schuessler | 30/43.92 |
| 3,561,118 | 2/1971 | Antretter | 30/346.51 |
| 3,771,842 | 11/1973 | Messinger | 30/346.51 |
| 3,945,118 | 3/1976 | Tolmie | 30/346.51 |

FOREIGN PATENT DOCUMENTS

| | | | |
|---|---|---|---|
| 0961866 | 4/1957 | Fed. Rep. of Germany . | |
| 1553633 | 4/1970 | Fed. Rep. of Germany . | |
| 1728376 | 12/1971 | Fed. Rep. of Germany . | |
| 2089829 | 1/1972 | France . | |
| 0404456 | 6/1966 | Switzerland | 30/346.51 |
| 1052244 | 12/1966 | United Kingdom | 30/346.51 |

*Primary Examiner*—Frederick R. Schmidt
*Assistant Examiner*—Robert A. Rose
*Attorney, Agent, or Firm*—Young & Thompson

[57] ABSTRACT

Arcuate shaver knives (1) maintained in parallel spaced relation and in alignment along a support (20) have inwardly-opening notches (5, 6) located opposite to two parallel longitudinal grooves (21, 22) formed in the support. The notches (5, 6) are locked on two locking-pins (30) which engage within the space formed between the grooves (21, 22) and the notches (5, 6) of the shaver knives.

8 Claims, 3 Drawing Sheets

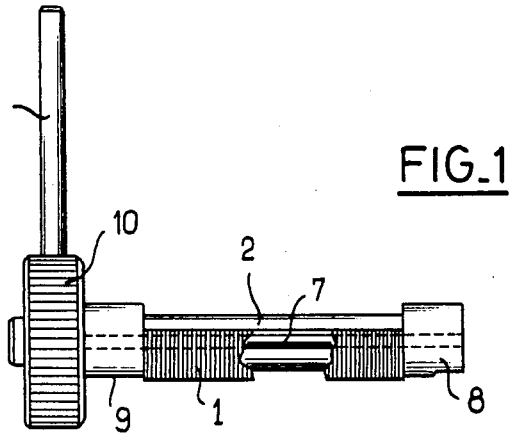
FIG. 1
FIG. 3
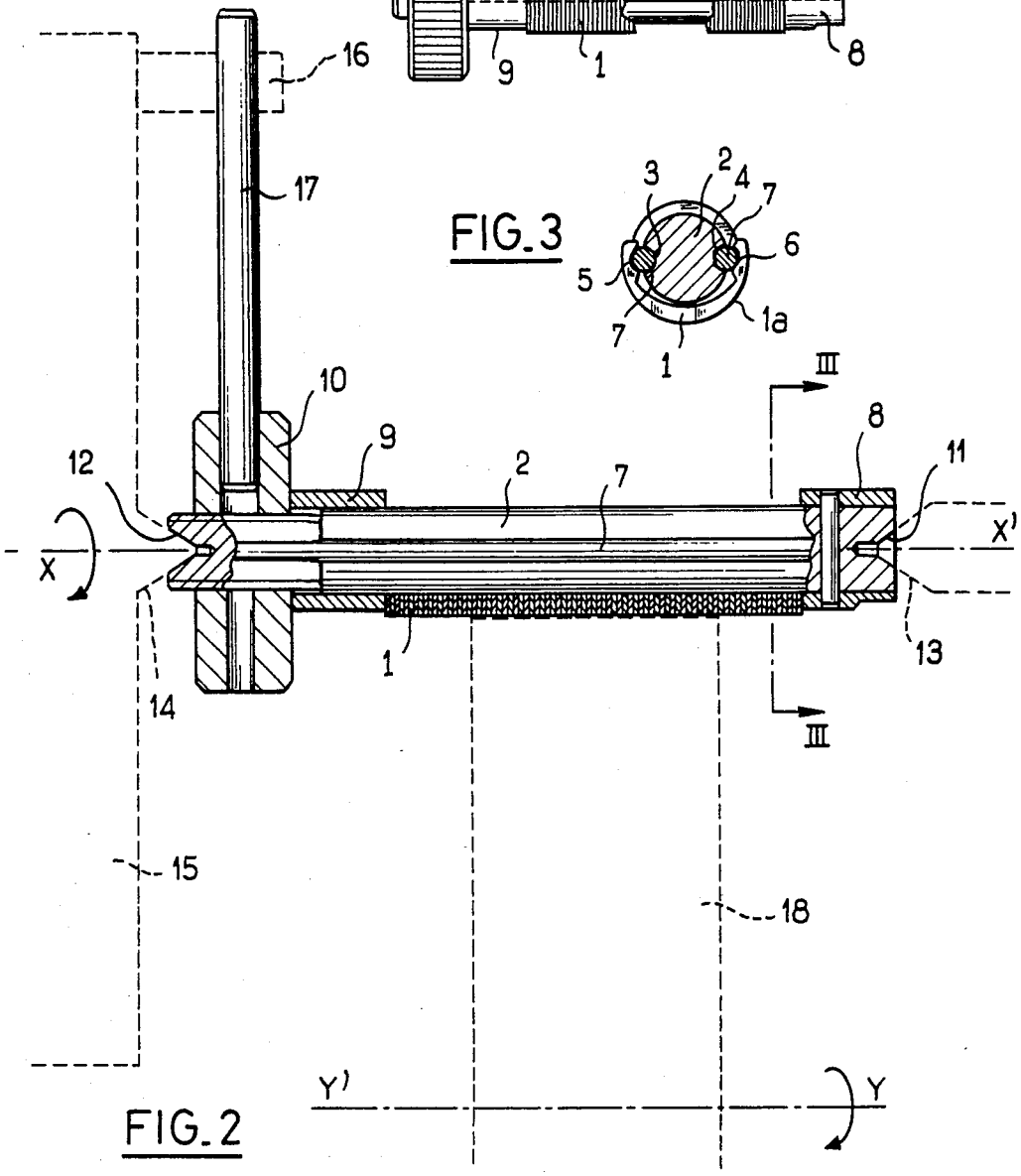
FIG. 2

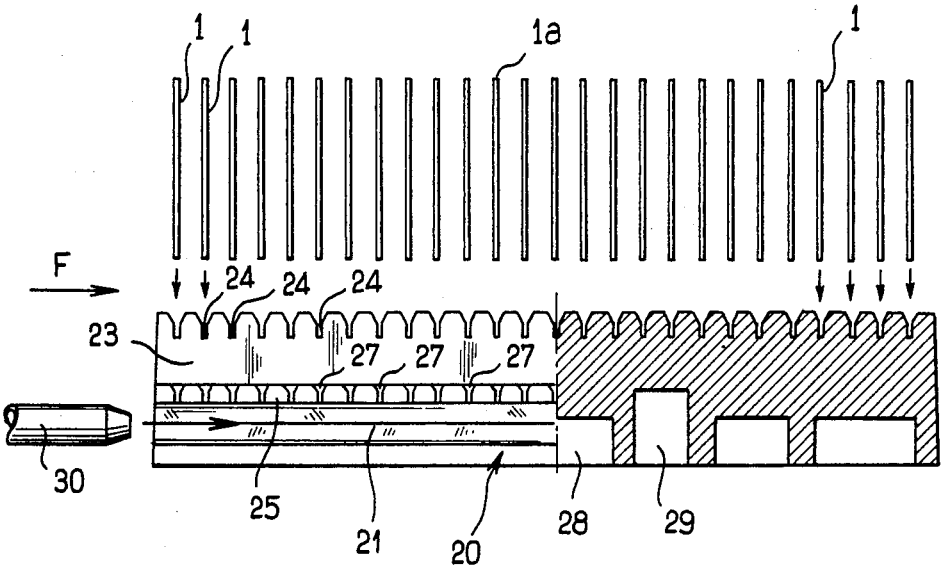
FIG_4
FIG_5
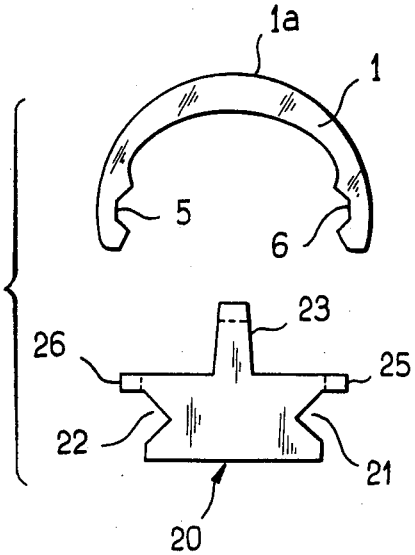
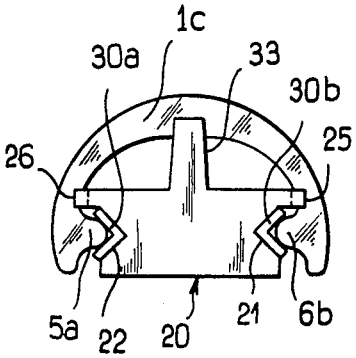
FIG_11

KNIVES FOR A GRID-TYPE SHAVER, A SUPPORT FOR THE SHAVER KNIVES, AND A METHOD FOR SHARPENING AND MOUNTING SAID KNIVES

BACKGROUND OF THE INVENTION

1. Field of the Invention

The present invention relates to knives for a grid-type shaver and to a support on which said knives are mounted, the function of the support being to maintain the knives in parallel spaced relation and aligned in the longitudinal direction of said support.

The invention is also directed to a method for sharpening shaver knives and to a method for mounting the knives on the shaver support.

2. Description of the Prior Art

In electric shavers of known types, the knives mounted on the support are covered by a stationary grid provided with a large number of small apertures. The cutting edges of the knives are designed to move over the apertures on the underface of the grid, the knives being all driven at the same time in a reciprocating movement of translation of the support under the action of an electric motor.

In the known forms of construction, the shaver knives are assembled on a support by crimping or overmolding when said support is of plastic material.

The knives mounted on the support are sharpened on a cylindrical grinder. This operation, however, leaves burrs on the cutting edges of the knives.

The cutting edges are then subjected to a fine-grinding operation by means of a complex and costly installation in order to remove the burrs mentioned above.

SUMMARY OF THE INVENTION

The object of the present invention is to produce knives for a grid-type shaver and a support which makes it possible to position and maintain the knives on the support with great ease and accuracy. This avoids any need to perform the costly operation involving removal of the burrs which remain after grinding the cutting edges of the knives.

In accordance with the invention, the knives for a grid-type shaver and the support on which said knives are mounted, the function of said support being to maintain the knives in spaced relation parallel to each other and aligned in the longitudinal direction of said support, the knives of arcuate shape being endowed with a predetermined degree of elasticity and provided with fastening means adapted to cooperate with locking means for mounting the knives on the support by elastic deformation of said knives, are distinguished by the fact that the knives are provided near each end of the arc with a notch having its opening on the inside of the arc, that the support has two longitudinal grooves parallel to the longitudinal direction of the support, the notches of the knives being placed opposite to said grooves, and that said notches are locked on two locking-pins engaged within the space formed between the two grooves and the notches of the knives.

This system of attachment by means of locking-pins which are retained within longitudinal grooves formed in the support and which lock the knives to the support by means of the notches formed in these latter permits very simple assembly of said knives on the support while guaranteeing a very high degree of accuracy of positioning of the knives on the support.

The notches formed in the knives can be replaced by bosses locked in V-section strips engaged in the longitudinal grooves of the support.

Moreover, this mode of attachment of the knives to the support by means of locking-pins permits application of a knife-sharpening process which prevents the formation of burrs on the cutting edges.

In accordance with the method contemplated by the invention, the shaver knives are placed on a mandrel having two longitudinal and parallel grooves relatively spaced at a distance equal to the distance between the two grooves of the knife support by positioning the notches or bosses of said knives opposite to said grooves, two locking-pins or strips of suitable cross-section are engaged within the space formed between each groove of the mandrel and the adjacent notches or bosses of the knives, the knives are clamped against each other, the mandrel is rotated about its axis and a grinding-wheel for sharpening all the knives is applied against the external surface of the knives which are stacked and clamped together on the mandrel.

The fact that the knives are clamped against each other prevents the formation of burrs on the cutting edges.

Moreover, by reason of the fact that the knives are positioned on the mandrel with high precision by means of two locking-pins having the same relative spacing as the locking-pins which are intended to position the knives on the knife support, it is ensured that the knives are positioned on said support with the same high degree of accuracy as the positioning of said knives on the sharpening mandrel.

According to another aspect of the invention, in order to mount the sharpened knives on the knife support, said sharpened knives are removed from the mandrel by withdrawing the locking-pins or the V-section strips, the knives are placed on the support and maintained in the order in which they were placed on the sharpening mandrel, the two locking-pins or the two V-section strips are forcibly engaged within the space formed between each longitudinal groove of the support and the adjacent notches of the knives.

In view of the fact that the knife-position order is maintained, the cutting edges of the knives are aligned with each other with high precision when said knives are placed on the knife support.

BRIEF DESCRIPTION OF THE DRAWINGS

Other features of the invention will be more apparent upon consideration of the following description and accompanying drawings, wherein:

FIG. 1 is a plan view of the mandrel on which the knives are mounted for the purpose of sharpening;

FIG. 2 is a longitudinal part-sectional view of the mandrel which is in position on a sharpening device shown in dashed outline;

FIG. 3 is a sectional view taken along the plane III—III of FIG. 2;

FIG. 4 is a side view in longitudinal half-section showing the knife support, the knives and a locking-pin prior to positioning of said knives on the support;

FIG. 5 is a view looking in the direction of the arrow F in FIG. 4;

FIG. 11 is a view which is similar to FIG. 7 and relates to another mode of attachment of the knives to the support.

DESCRIPTION OF THE PREFERRED EMBODIMENTS

Figure 6:
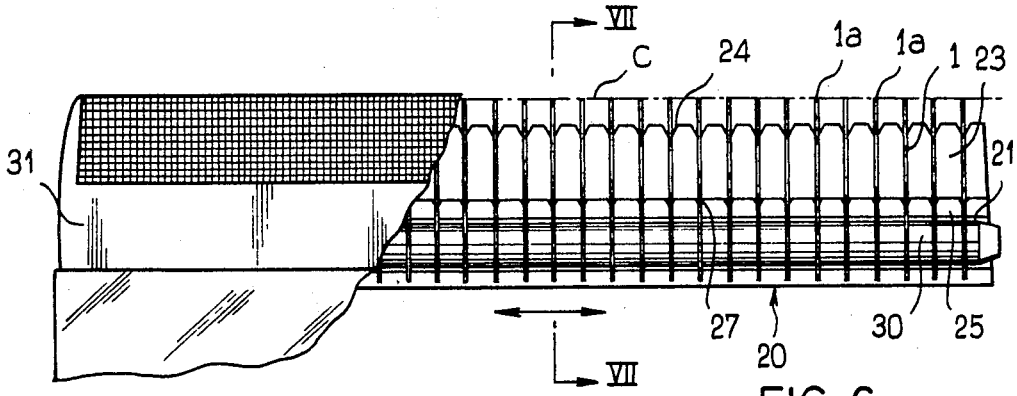
FIG. 6 is a view in elevation showing the support which carries the knives and is covered by the grid which is partially broken away.
Figure 7:
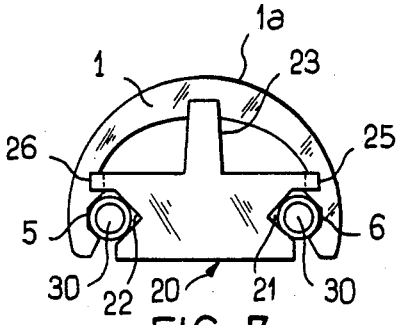
FIG. 7 is an end view of the support which carries the knives.
Figure 8:
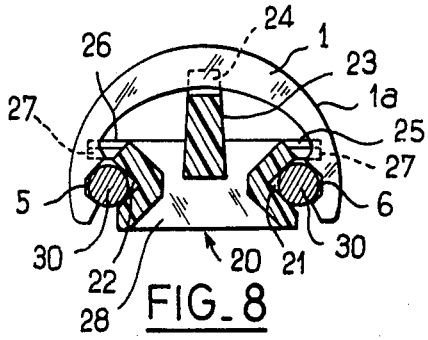
FIG. 8 is a sectional view taken along the plane VII—VII of FIG. 6.

Referring to FIGS. 1 to 3, the method for sharpening shaver knives in accordance with the invention will first be described.

Said knives 1 are of hardened steel and have the general shape of a circular arc (as shown in FIG. 3). Each knife 1 is constituted by a curved blade having a substantially constant deformation along its curved edge. A notch 5, 6 is formed at each end of the arc of a knife 1 and opens towards the interior of the arc.

Said knives 1 are placed on a cylindrical mandrel 2 having two longitudinal and parallel grooves 3, 4 which extend along two diametrical generator-lines of the mandrel 2.

The knives 1 are placed on the mandrel 2 in positions such that the notches 5, 6 of the knives are located substantially opposite to the longitudinal grooves 3, 4 of the mandrel 2.

A locking-pin 7 is then forcibly engaged within the space formed between each longitudinal groove 3, 4 of the mandrel 2 and the adjacent notches 5, 6 of the knives. The two locking-pins 7 (one on each side) thus ensure accurate positioning of the knives 1 on the mandrel 2.

As shown in FIGS. 1 and 2, one end of the mandrel 2 is adapted to carry a stationary bearing ring 8. The other end of said mandrel 2 is adapted to carry a movable ring 9 against which is screwed a nut 10.

The knives 1 which are stacked on the mandrel 2 are clamped together between the rings 8 and 9 by means of the nut 10.

The opposite ends of the mandrel 2 are provided with conical centering holes 11, 12 for placing said mandrel between two conical points 13, 14 (shown in dashed outline in FIG. 2). Said points are located on an axis X-X' which constitutes the axis of rotational driving motion of a grinding and sharpening machine.

The point 14 is adjacent to a rotary catchplate 15 which is also shown in dashed lines in FIG. 2 and carries a catch-pin 16, said catch-pin being applied against a lever 17 which is secured to the nut 10 of the mandrel 2. The catch-plate 15 thus drives the mandrel 2 in rotation by means of the catch-pin 16 and the lever 17.

The mandrel 2 is driven in a reciprocating movement of translation along the axis X-X' under the control of a device which is not illustrated in the drawings.

A grinding-wheel 18 is applied against the cylindrical external surface defined by the stack of knives 1 and is mounted for rotation about an axis Y-Y'. Said grinding-wheel 18 rotates in the same direction as the mandrel 2 and thus has the function of sharpening all the knives 1. Since these knives are clamped against each other, no burr is formed on the arcuate cutting edge 1*a* of said knives 1.

The method adopted for mounting the sharpened knives 1 on the shaver support will now be described.

In the embodiment illustrated in FIGS. 4 to 9, the support 20 formed of plastic material is provided on each side with two longitudinal grooves 21, 22 extending parallel to the longitudinal direction of the support.

Said support 20 comprises a projecting central rib 23 which extends in the longitudinal direction of the support. As shown in FIG. 4, the upper end of said rib 23 is provided with uniformly spaced slots 24 which are perpendicular to the support and are each intended to receive a knife 1.

Said support 20 further comprises two parallel flanges 25, 26 (shown in FIG. 5) located in a plane perpendicular to the central rib 23.

It is apparent from FIG. 4 that each flange 25 or 26 is provided with uniformly spaced slots 27 which are intended in each case to receive a knife 1 in the same manner as the slots 24. Each knife 1 is intended to be fitted in three slots, namely a slot 24 and two slots 27 disposed in a plane at right angles to the longitudinal axis of the support 20, the two slots 27 being located at 90° on each side of the slot 24.

It is further apparent from FIG. 5 that the flanges 25 and 26 extend along the top of the longitudinal grooves 21 and 22 which are formed in the sides of the support 20.

FIG. 4 shows in addition that the bottom face of the support 20 is provided with recesses 28, 29, at least one of which is intended to receive a lug (not shown) driven by a motor for displacing the support 20 in a reciprocating movement of translation in the direction of its longitudinal axis.

In order to place the sharpened knives 1 in position on the support 20, the initial operation consists in removing said knives from the mandrel 2 by unscrewing the nut 10 and withdrawing the two locking-pins 7.

The knives 1 are placed on the support 20 by engaging each knife in a slot 24 and in the two slots 27, the order in which these knives had been placed on the sharpening mandrel 2 being maintained. Two locking-pins 30 (shown in FIGS. 4, 6, 7 and 8) are then forcibly engaged in the spaces formed between each longitudinal groove 21 and 22 of the support 20 and the adjacent notches 5, 6 of the knives 1. Thus the notches 5 and 6 of the knives 1 are locked to the two pins 30 which are in turn retained in the grooves 21 and 22 of the support 20.

By reason of the fact that the distance between the two locking-pins 30 engaged in the grooves 21 and 22 of the support 20 is the same as the distance between the locking-pins 7 (the diameter of which is equal to the diameter of the locking-pins 30) which had previously served to position the knives 1 on the sharpening mandrel 2 and also by reason of the fact that the order of the positions of the knives 1 on the support 20 is the same as on the mandrel 2, the knives 1 are placed on the support 20 with a very high degree of accuracy. Thus the cutting edges 1*a* which have been sharpened are located on a cylindrical surface C (shown in a chain-dotted line in FIG. 6) which exactly corresponds to the cylindrical surface in which said edges 1*a* were located when the knives 1 were in position on the mandrel 2 after they had been sharpened.

Figure 9:
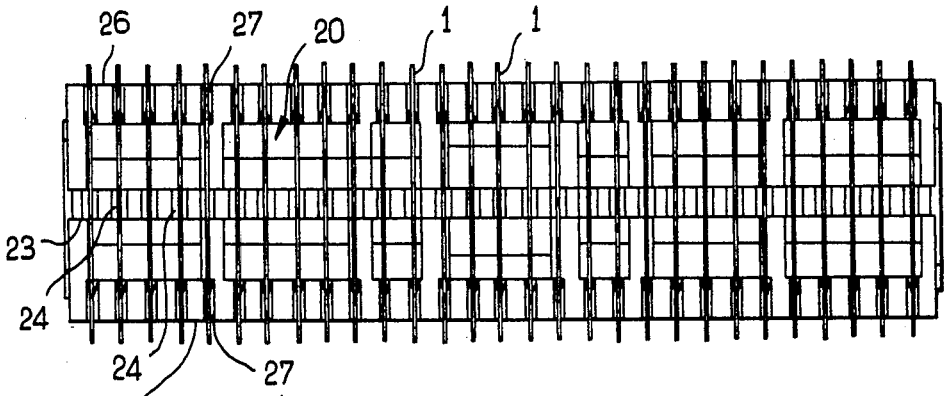
FIG. 9 is a top view of the support which carries the knives.

By reason of the fact that the surface in which the cutting edges 1*a* are located after sharpening may have a slightly frusto-conical shape as a result of grinding tolerances, perfect compliance with this surface is achieved after mounting the knives 1 on the support 20, with the result that the cutting edges 1*a* are perfectly aligned with each other in all cases, as shown in FIGS. 6 and 9.

Once the knives 1 have been mounted on the support 20, this support can be placed directly in the shaver without any need to re-grind the cutting edges 1*a* of said knives since these cutting edges do not have any burrs.

It is then only necessary to fit the grid 31 in position (as shown in FIG. 6) so as to cover the support 20 which carries the knives 1.

It is clearly apparent that the operations which consist in removing the knives 1 from the mandrel 2 and then placing said knives 1 in the same order on the shaver support 20 can be carried out in a fully automatic manner by means of a machine which operates at high speed in order to permit mass production.

As can readily be understood, the invention is not limited to the examples described in the foregoing and many modifications can accordingly be contemplated without thereby departing either from the scope or the spirit of the invention.

Thus the cutting edge 1*a* of the knives can have a shape other than that of a circular arc.

Figure 10:
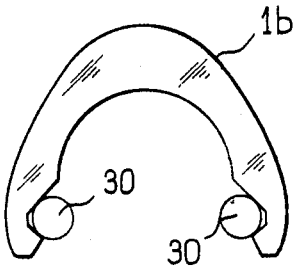
FIG. 10 is a view of an alternative embodiment of knives.

In the embodiment of FIG. 10, the cutting edge 1*b* of the knife has the shape of a triangular eccentric arc.

This arc has the property of possessing a center as in the case of a circular arc, all the diameters which pass through this center being equal.

Said cutting edge 1*b* is shaped so as to have a relatively short radius of curvature at the crest of the arc. This crest portion of the arc proves wholly suitable for the purpose of shaving those parts of the user's face which are not readily accessible or for accurate stopping of the cutting edge around the ends of a beard and of a moustache whereas the relatively long radius of curvature on the sides of the arc are suitable for shaving the user's cheeks.

Sharpening of knives having this shape can be performed by grinding said knives when they are stacked together as in the case of the method described earlier but by means of a machine for grinding polygonal shafts which is in widespread use in the automobile industry.

As will readily be apparent, the invention is not limited to the means described in the foregoing for attaching and locking the knives of the support. Thus in the example of FIG. 11, the ends of the knife 1*c* are provided with bosses 5*a*, 5*b* which are directed towards the interior of the arc. Strips 30*a*, 30*b* having a V-shaped cross-section which is complementary to that of the longitudinal grooves 21 and 22 are forcibly engaged (that is to say by producing elastic deformation of the knives) within the space formed between the aforesaid bosses 5*a*, 5*b* and said grooves 21 and 22.

V-section strips which are identical with the strips 30*a*, 30*b* serve to carry out accurate positioning of the knives 1*c* on a mandrel which is similar to that shown in FIGS. 1 to 3 and which is employed instead of the locking-pins 7. Alternatively, the distance between the V-shaped grooves 3 and 4 of the mandrel could be identical with the distance between the V-shaped cross-sections of the strips 30*a* and 30*b* when these latter are assembled on the support.

The longitudinal grooves such as those designated by the references 21, 22 and formed in the support 20 could be replaced by stationary ribs on which the notches 5, 6 of the knives could be positioned by snap-action engagement. Similar means could be provided on the mandrel for the purpose of ensuring that the knives are positioned on the support in the same manner as on the sharpening mandrel.

It would of course be possible to provide only one locking-pin or V-section strip on one side of the support, the other side of the knives being directly retained on the support without interposition of a locking-pin or like means for locking in position by elastic deformation of the knives.

What is claimed is:

1. An assembly comprised of knives (1) for a grid-type shaver (31) and an elongated support (20) having a longitudinal direction on which said knives are mounted, said support (20) maintaining the knives in spaced relation parallel to each other and aligned in said longitudinal direction of said support, each of the knives (1) having the shape of an arc comprising two opposed ends and having a predetermined degree of elasticity and having near each end of said arc a notch (5, 6) having its opening on the inside of said arc, the support (20) having two longitudinally extending spaced grooves (21, 22) parallel to said longitudinal direction of the support, the opposed notches (5, 6) of each of the knives (1) each being opposite a respective one of said grooves (21, 22) and a locking pin (30) engaged forcibly respectively within each of said two longitudinally extending grooves (21, 22) and the notches (5, 6) of the knives which are opposite to each of said grooves (21, 22), so that the knives are biased elastically outwardly by said locking pins with said two opposed ends of each of said knives being maintained in lateral spaced relation from said support.

2. An assembly according to claim 1, wherein the support (20) has slots (24, 27) which are perpendicular to the longitudinal direction of the support and in which the knives (1) are positioned.

3. An assembly according to claim 2, wherein the support (20) comprises a projecting central rib (23) which extends in the longitudinal direction of the support and the end portion of which has slots (24) for receiving the knives (1).

4. An assembly according to claim 3, wherein the support (20) has two parallel flanges (26, 25) located in a plane perpendicular to the central rib (23) and having slots (27) for receiving the knives (1).

5. An assembly according to claim 4, wherein the flanges (26, 27) extend along the top of the longitudinal grooves (21, 22), and locking-pins (30) disposed in the longitudinal grooves (21, 22).

6. An assembly according to claim 1, wherein the cutting edge (1*a*) of the knives has the shape of a circular arc.

7. According to claim 1, wherein the cutting edge (1*b*) of the knives has the shape of a triangular eccentric arc.

8. Knives and support according to claim 1, wherein the knives have sharpened cutting edges.

* * * * *